US006148781A

United States Patent [19]

Boegner et al.

[11] Patent Number: 6,148,781

[45] Date of Patent: Nov. 21, 2000

[54] STARTING DEVICE FOR AN INTERNAL COMBUSTION ENGINE, ESPECIALLY OF A MOTOR VEHICLE, WITH A REDUNDANCY CIRCUIT

[75] Inventors: Karlheinz Boegner, Neuhausen; Stefan Renner, Weissach; Martin Mayer, Sersheim; Claus Kramer, Besigheim; Rainer Topp, Reutlingen; Volker Koelsch, Stuttgart; Henning Stoecklein, Hemmingen; Jochen Neumeister, Stuttgart; Frank Kurfiss, Mühlacker, all of Germany

[73] Assignee: Robert Bosch GmbH, Stuttgart, Germany

[21] Appl. No.: 08/899,991

[22] PCT Filed: Jan. 9, 1996

[86] PCT No.: PCT/DE96/00030

§ 371 Date: Nov. 2, 1998

§ 102(e) Date: Nov. 2, 1998

[87] PCT Pub. No.: WO96/23970

PCT Pub. Date: Aug. 8, 1996

[30] Foreign Application Priority Data

Feb. 3, 1995 [DE] Germany ..... 195 03 538
Sep. 2, 1995 [DE] Germany ..... 195 32 484

[51] Int. Cl.[7] ..... F02N 11/08

[52] U.S. Cl. ..... 123/179.3; 290/38 R

[58] Field of Search ..... 123/179.1, 179.3, 123/179.25; 290/38 R; 307/10.3–10.6

[56] References Cited

U.S. PATENT DOCUMENTS

| | | | |
|---|---|---|---|
| 4,209,709 | 6/1980 | Betton | 307/10.4 |
| 4,533,016 | 8/1985 | Betton | 180/287 |
| 4,731,543 | 3/1988 | Buetemeister et al. | 290/38 R |
| 4,739,736 | 4/1988 | Branco | 123/179.3 |
| 5,550,701 | 8/1996 | Nadd et al. | 361/103 |

FOREIGN PATENT DOCUMENTS 2836047 3/1980 Germany .

*Primary Examiner*—Andrew M. Dolinar
*Attorney, Agent, or Firm*—Michael J. Striker

[57] ABSTRACT

The starting device for starting an internal combustion engine includes a starter motor (12) with a pinion for cranking the internal combustion engine; a voltage source (40) for the starter motor; a starter relay (14) for connecting and disconnecting the voltage source to and from the starter motor and an electronic relay (32) for triggering the starter relay according to control signals from the motor controller (50). The electronic relay (32) is mounted on the starter motor or in the starter relay. The electronic relay (32) includes a power module (34) with a redundancy circuit including two transistors (144', 144") coupled with each other by a logic circuit for preventing starter operation when one of the two transistors is defective.

9 Claims, 14 Drawing Sheets

STARTING DEVICE FOR AN INTERNAL COMBUSTION ENGINE, ESPECIALLY OF A MOTOR VEHICLE, WITH A REDUNDANCY CIRCUIT

BACKGROUND OF THE INVENTION

1. Field of the Invention

The invention relates to a starting device for starting an internal combustion engine, in particular of a motor vehicle, with a starter motor which can be connected via a starter relay with a voltage source and can be engaged with the internal combustion engine for turning the engine over, and an electronic device for triggering the starter relay.

2. Prior Art

It is known that internal combustion engines must be started by means of a starter, since they do not start up by themselves. Starter motors are usually employed for this, which are connected to a voltage source by means of a starter relay embodied as a so-called solenoid switch, and simultaneously a pinion gear of the starter motor is brought into engagement with the internal combustion engine for turning it over. For switching the starter relay on, it is known to trigger it by means of an external switch, for example an ignition switch or starter switch of the motor vehicle or an external relay. The relatively high current which flows when the starter relay is activated can be better controlled by means of this. By means of this current the starter relay generates the required force for shifting the starter and to close a contact bridge for connecting the starter motor with the voltage source. In a known manner the starter relay has a pull-in winding and a holding winding for this. Following the completed start, the starting process is terminated by the driver of the motor vehicle by disconnecting the voltage source from the starter motor.

A control circuit for triggering the starter relay is known from DE-OS 28 36 047, by means of which an erroneous manual operation of the starter relay, for example via an ignition switch, a starter switch or a combined ignition-starter switch, is intended to be prevented. Further than that, electronic installations are known, for example from U.S. Pat. No. 4,739,736, which are used for triggering the starter relay of a starter.

SUMMARY

It is an object of the present invention to provide an improved starting device of the above-described kind for starting an internal combustion engine, particularly a motor vehicle, especially which operates in a more dependable manner.

According to the invention the starting device for starting an internal combustion engine includes:

a starter motor with means for engaging the internal combustion engine, advantageously comprising a pinion gear, for turning over the internal combustion engine;

a voltage source of electrical power for the starter motor, usually a battery and a regulated generator connected with the battery for charging it;

a starter relay for connecting the voltage source with the starter motor to activate the starter motor; and an electronic device for triggering the starter relay so that the starter relay connects the voltage source with the starter motor;

wherein the electronic device is formed by an electronic relay and the electronic relay is mounted on the starter motor or in the starter relay and has a logic signal input for control signals from a motor controller of the internal combustion engine; and wherein the electronic relay comprises a power module and is provided with a redundancy circuit in which the power module has two transistors redundantly coupled with each other by means of a logic circuit.

The starting device in accordance with the invention with the offers the advantage, that the starting process of the internal combustion engine can take place automated and simultaneously coordinated as a function of further functional states of the motor vehicle. Because the electronic installation is constituted by an electronic relay disposed on or in the starting device and can be triggered via a logic signal input by an electronic engine control device of the motor vehicle, it is advantageously possible to achieve the low-output and therefore low-energy and wear-free initiation or the termination of the starting process. Various control functions of the starter relay can be contacted in a simple manner by means of the electronic triggering via an engine control device which as a rule is provided in a motor vehicle. It is possible in this way to achieve the supply of the starter relay with pull-in and holding current during the starting process, a dependable disconnection of the pull-in and holding current, or possibly only the holding current, at the termination of the starting process. Following the termination of the starting process it is possible to realize a dependable disconnection of the starter from the electric system of the motor vehicle, so that erroneous operations, in particular the initiation of a starting process while the internal combustion engine is running, can be prevented. Further than that, it is simultaneously possible in a very advantageous manner via the electronic relay combined with the starting device achieve self-protection against overloads in the form of an excess-voltage protection, excess-current protection and/or excess-temperature protection.

In an advantageous embodiment of the invention it is provided that the electronic relay is designed in such a way that it can be integrated into the starting device, i.e. the electronic relay is embodied as a module-like component, which can be arranged either on functional units or in functional units of the starting device. Because of this no, or very little, additional structural space is required for the electronic relay. Further than that, additional wiring inside the motor vehicle is not required. It is therefore also possible to retrofit motor vehicles, which up to that time did not have an appropriate electronic installation for controlling the starting device, by means of an exchange of the entire starting device or of parts of the starting device which have the electronic device.

Advantageous embodiments of the invention ensue from the characteristics mentioned in the dependent claims.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE EXEMPLARY EMBODIMENTS

Figure 1:
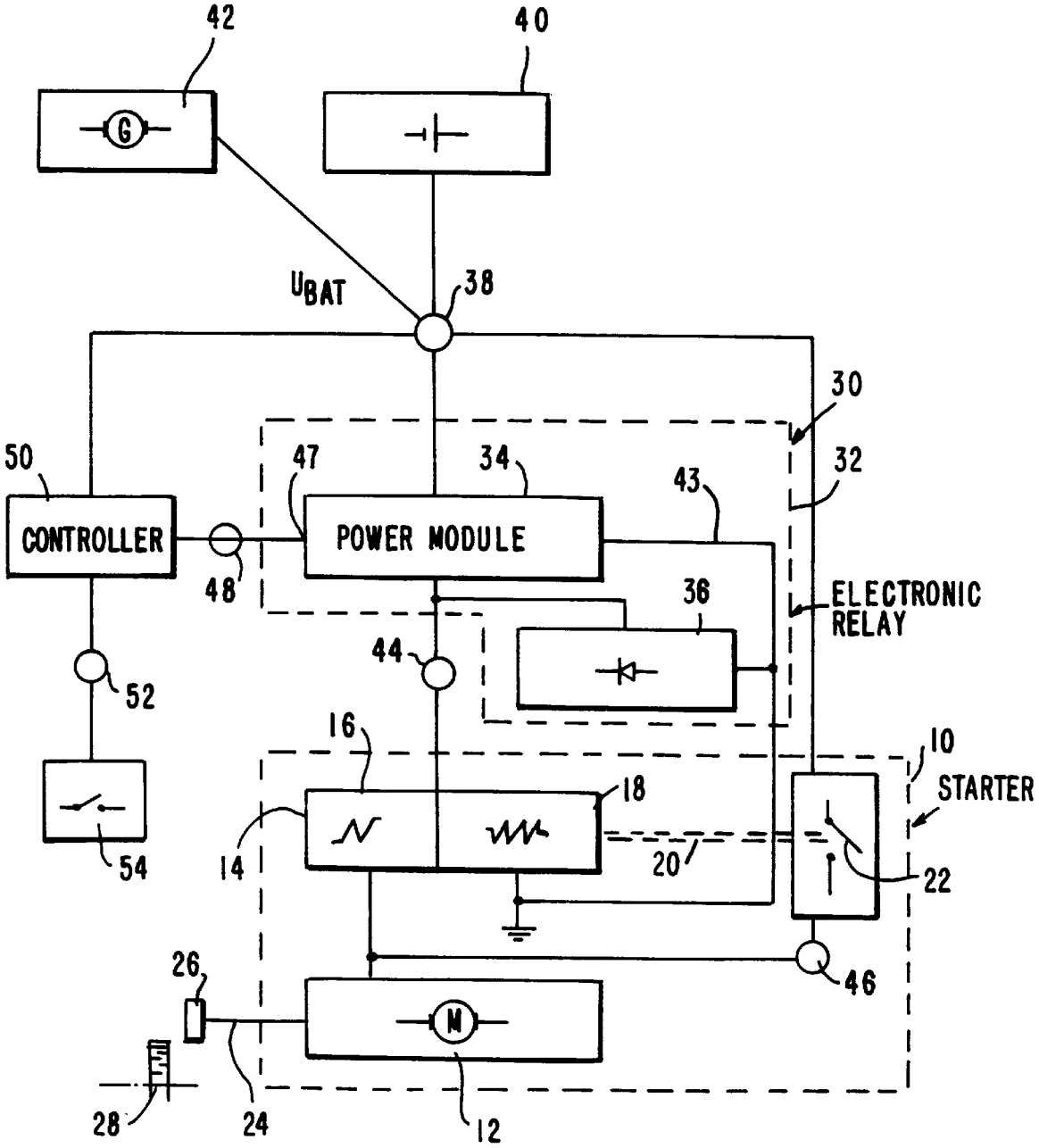
FIG. 1 is a block diagram of a starting device according to the invention.

The total device for starting a motor vehicle is explained by means of the block wiring diagram represented in FIG. 1. A starter 10 has a starter motor 12 and a starter relay 14. The starter relay 14 has a pull-in winding 16 and a holding winding 18. A switch shaft 20 of the starter relay 14 indicated here supports a connecting bridge 22. On its driveshaft 24 the starter motor 12 has an axially displaceable pinion gear 26, which can be brought into engagement via the switch shaft 20 of the starter relay 14 (solenoid switch) with a gear wheel 26, here indicated, of an internal combustion engine, not represented.

An electronic device 30, which hereinafter will be identified as a whole by electronic relay 32, is associated with the starter 10. The electronic relay 32 has a power module 34 and a free-wheeling diode 36. The power module 34 is connected with a connecting terminal 38, which is connected with a voltage source of the motor vehicle. Generally a battery 40 and a generator 42 are employed as the voltage source of the motor vehicle. The power module 34 is furthermore provided with a ground connection 43 and is connected with a connecting terminal 44, which is connected with the pull-in winding 16 and the holding winding 18 of the starter relay 14. In this way the power module 34 represents a switching means located between the connecting terminals 38 and 44. The connecting terminal 44 is furthermore connected with the cathode of the free-wheeling diode 36, whose anode is connected to ground, so that the free-wheeling diode 36 is switched parallel with the holding winding 18 of the starter relay 14. The connecting terminal 38 is furthermore connected with a first contact of the connecting bridge 22, whose second contact is connected with a connecting terminal 46. The connecting terminal 46 is connected with the winding of the starter motor 12 and the pull-in winding 16 of the starter relay 14.

A logical signal input 47 of the power module 34 is connected via a connecting terminal 48 with the electronic engine control device 50 of the motor vehicle. The engine control device 50 is furthermore connected with the connecting terminal 38 and, via a connecting terminal 52, with an ignition lock 54 of the motor vehicle.

The arrangement represented in FIG. 1 performs the following function:

If the motor vehicle, not represented, is to be started, the electronic engine control device 50 is activated by the operation of the ignition lock 54. It thereafter provides a triggering signal to the electronic relay 32, which is applied to the logic signal input 47 of the power module 34. This signal provides the information that the starting process is to be initiated.

The triggering signal applied to the logic signal input 47 consists, for example, of a voltage, for example a voltage of more than 8 V to ground, which is applied during the entire starting process. The electronic relay 32 can be constructed in such a way that the triggering voltage can drop during the starting process, for example to a value of less than 4 V, without the starting process being interrupted. The electronic relay has a high input resistance, so that the control current flowing over the logic signal input 47 has a low current strength of, for example, less than 0.1 A. The small current strength can be supplied without problems by an end stage of the engine control device 50.

Because of the application of the switch-on signal to the logic signal input 47, the power module 34 switches the supply voltage $U_{bat}$ applied to the connecting terminal 38 through to the pull-in winding 16 and the holding winding 18 of the starter relay 14. By means of this the switch shaft 20 of the starter relay 14 is axially moved in a generally known manner, so that on the one hand the pinion gear 26 of the starter motor 12 is brought into engagement with the toothed rim 28 and, on the other hand, the connecting bridge 22 is closed. Because of this the supply voltage $U_{bat}$ is applied to the connecting terminal 46, and the starter motor 12 is connected with a required operating voltage. The pull-in winding 16 is simultaneously disconnected from the current, since its winding start lies on the same potential via the connecting terminal 44 as its winding end via the connecting terminal 46. The starter relay 14 is only provided with current via the holding winding 18, which provides a sufficiently large holding force for the switch shaft 20.

If the control signal applied to the logic circuit input 46 is affected by means of the engine control device 50 in such a way, that it drops below the switch-off voltage of the electronic relay 32, or if the input 46 is connected to ground, the power module 34 separates the connecting terminals 38 and 44, so that the holding winding 44 is without current and therefore the starter relay 14 drops. Because of this the pinion gear 26 is disconnected, on the one hand, and the connecting bridge 22 is opened. The starting process is therefore terminated and the internal combustion engine 28 is turned over. The free-wheeling diode 36 assures that excessive inductive voltages being generated when the holding winding 18 is switched off can be reduced.

Figure 2:
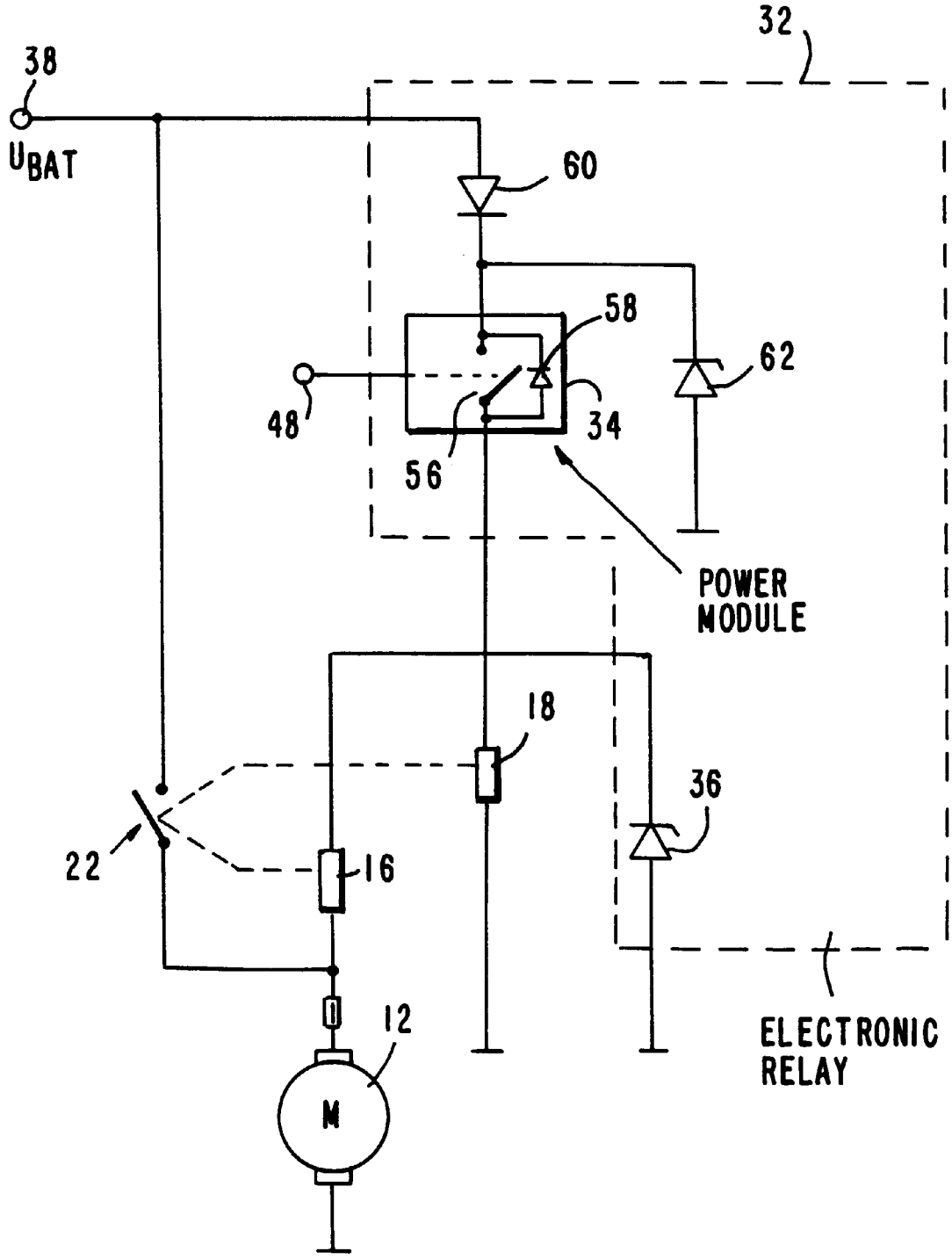
FIG. 2 is a circuit diagram for the starting device shown in FIG. 1.

FIG. 2 shows a wiring diagram of the arrangement represented in FIG. 1. Like elements as those in FIG. 1 have been provided with the same reference numerals and will not be explained again. By means of the wiring diagram it becomes clear that the electronic relay 32 has a power module 34 embodied as the switching means 56. A protective diode 58 is switched parallel with the switching means 56. A reverse polarity protection diode 60 is furthermore provided, whose anode is connected with the connecting terminal 38 and whose cathode is connected with the power module 34. The reverse polarity protection diode is used to protect the power module 34 against erroneous connection. However, reverse polarity protection can also be assured by means of structural steps, which assure the unequivocal installation of the electronic relay 32, so that the installation of the reverse polarity protection diode 60 can be omitted. An excess-voltage diode 62 is furthermore provided, which is intended to protect the power module 34 from excess voltages from the electrical system of the motor vehicle. When operating the generator 42 (FIG. 1) in particular, there can be the usual voltage fluctuations. However, if the generator 42 is equipped with so-called load-dump diodes, which per se already assure an excess-voltage protection, the installation of the excess-voltage diode 62 can also be omitted.

The power module 34 is a smart power MOSFET which, besides the switching means 56 realized by a power transistor, has an integrated excess-voltage protection, an excess-current protection and a temperature switch-off, so that the power module 34 protects itself against overloads. The MOSFET is designed as a high-side switch with integrated charge pump.

Figure 3A:
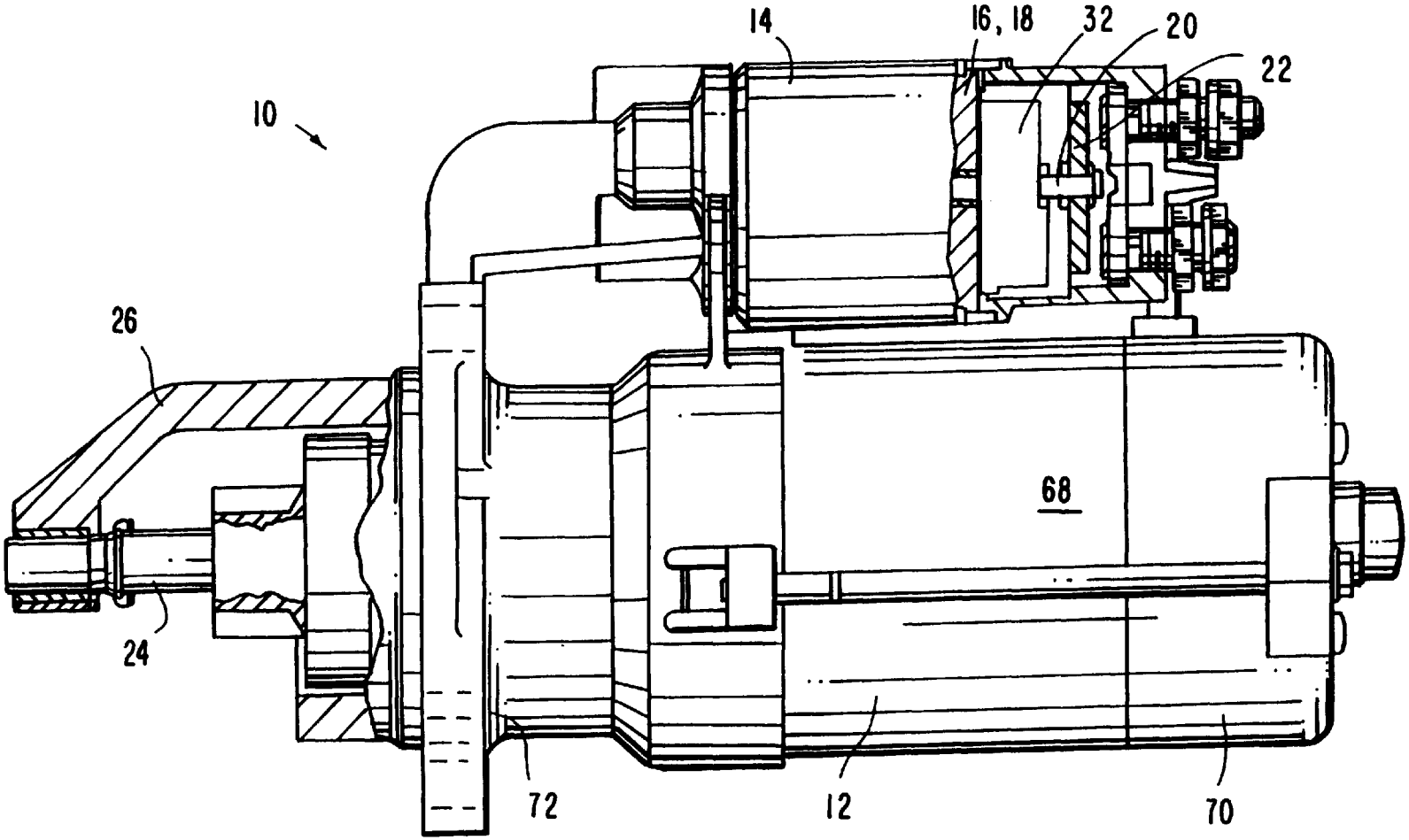
FIGS. 3*a*, 3*b* and 3*c* are partially cutaway side views of the starting device according to the invention showing the electronic relay arranged in different locations in the starting device.
Figure 3B:
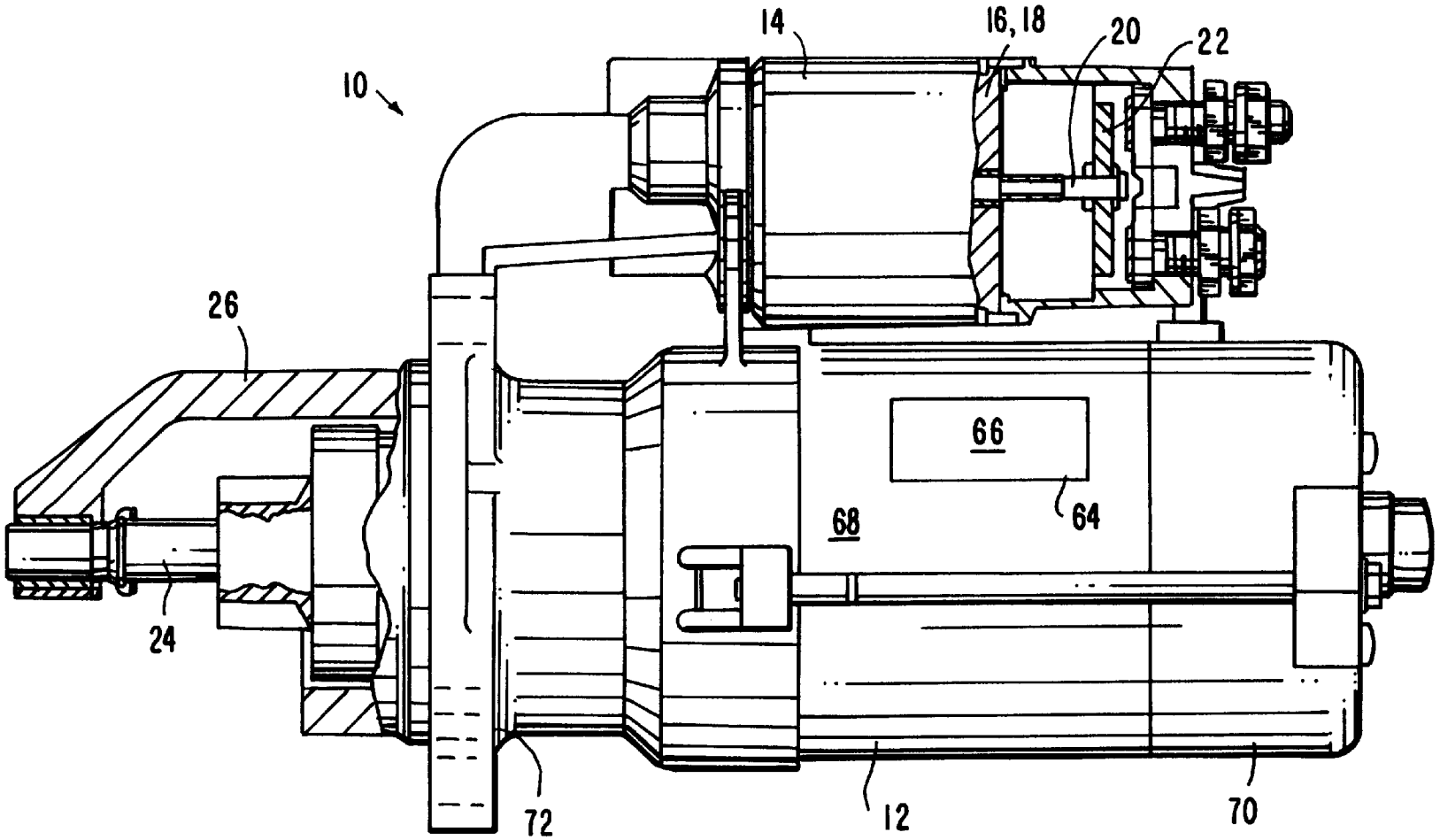
Figure 3C:
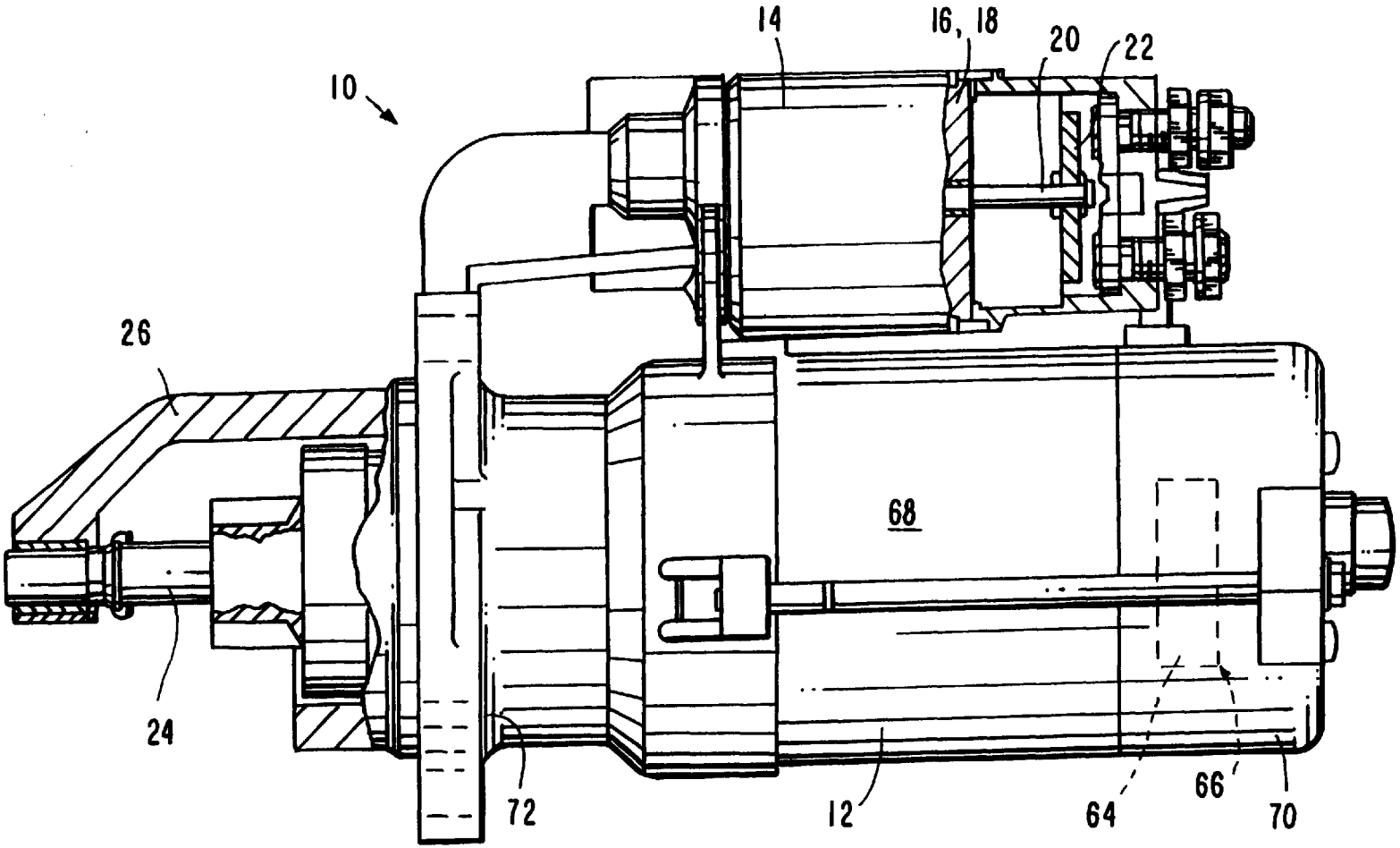

A partially cut lateral view of the starter 10 is represented in FIGS. 3*a*, 3*b* and 3*c*. The explanation of details not relevant to the instant invention was omitted, particularly since the design of the starter 10 is generally known. It is intended by means of FIGS. 3*a*, 3*b* and 3*c* to point out the possible installation locations for the electronic relay 32 inside the starter 10. A first possibility as shown in FIG. 3*a* consists in integrating the electronic relay 32 into the starter relay 14. An installation space between the windings 16 and 18 of the starter relay and the connecting bridge 22 can be used for this purpose. In this case the electronic relay 32 has a structure which will be explained in even more detail by means of FIGS. 4 to 7. The installation location of the electronic relay 32 in the starter relay 14 has the advantage that a closeness of the location with the connecting terminals of the starter 10 and the holding winding 18 as well as the pull-in winding 16 of the starter relay 14 is provided.

Further than that it is possible to arrange the electronic relay 32 at the position indicated by 64 as shown in FIG. 3*b*. To this end the electronic relay 32 can be embodied as an appropriately encapsulated module 66, which is attached, for example by screwing, to a pole housing 68 of the starter motor 12. A space below a commutator bearing cap 70 or on the cap 70 as indicated in FIG. 3*c* or in the area of the drive bearing 72 of the starter motor 12 is possible as a further installation location. It would be necessary for this to match the commutator bearing cap 70 or the housing part surrounding the drive bearing 72 to correspond to the structural form of the electronic relay 32. Within the framework of the instant description it is not intended to fix on a defined installation space of the electronic relay 32, instead, it is intended to show the various options of the space-saving arrangement in combination with the entire starter 10. As a whole it is therefore possible to arrange the electronic relay 32 without the starter 10 requiring a larger, possibly only slightly larger installation space in the motor vehicle. Further than that, by combining the electronic relay 32 with the starter 10 it is possible to replace starters 10 already installed in motor vehicles by a starter 10 which has an electronic relay 32.

A definite structural design of an electronic relay 32 will be explained by means of FIGS. 4, 5, 6 and 7, wherein it is assumed here that the electronic relay 32 is integrated into the starter relay 14. In this connection FIGS. 4 and 5 represent a top view on the electronic relay 32, wherein a cover has been removed in FIG. 5, so that it is possible to look into the electronic relay 32.

Figure 4:
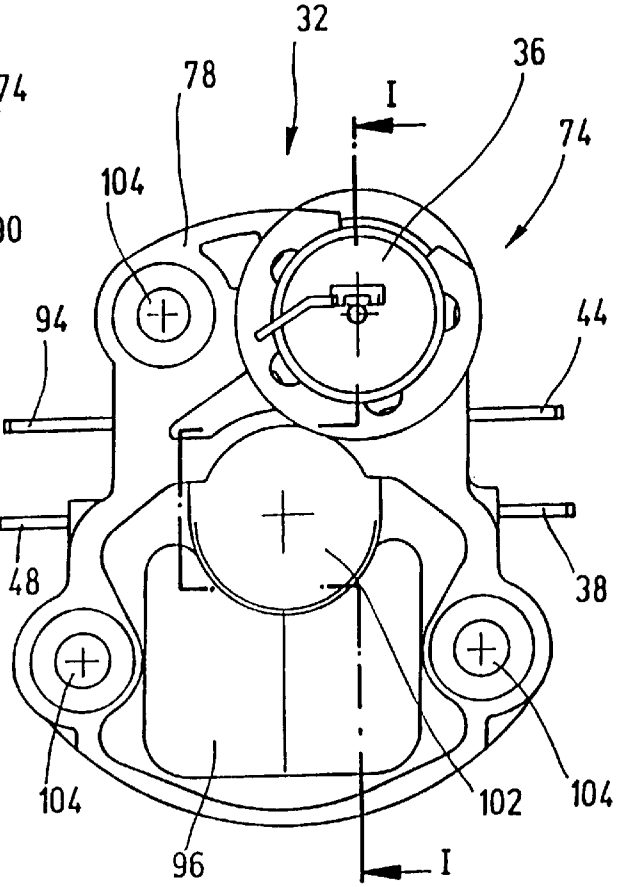
Figure 6:
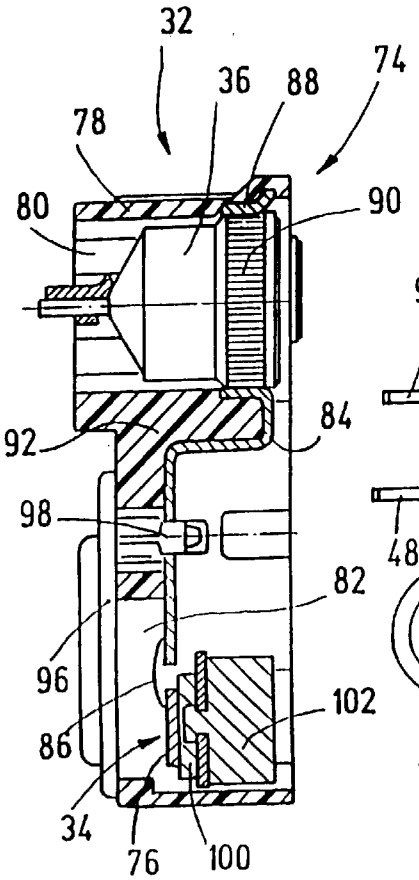
Figure 7:
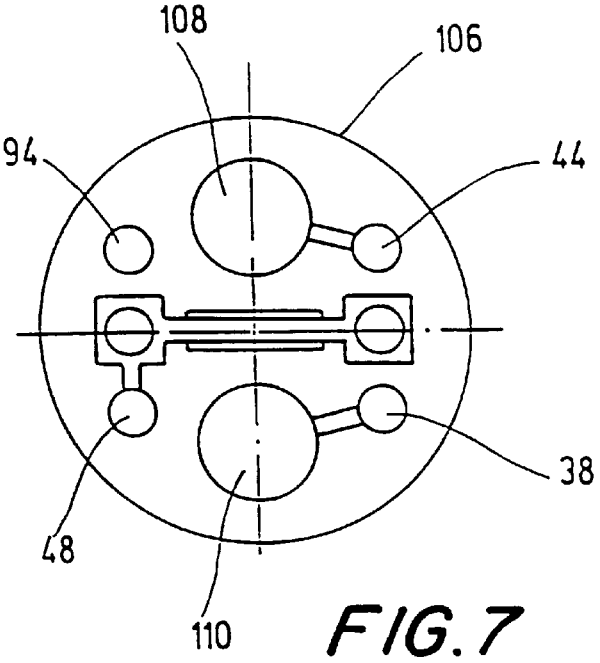
FIG. 7 is an exterior view of a switch cover of a starter relay.

FIG. 6 shows a sectional view of the electronic relay 32 in accordance with the line I—I in FIG. 4, while FIG. 7 represents a top view on a switch cover of the starter relay 14.

Figure 5:
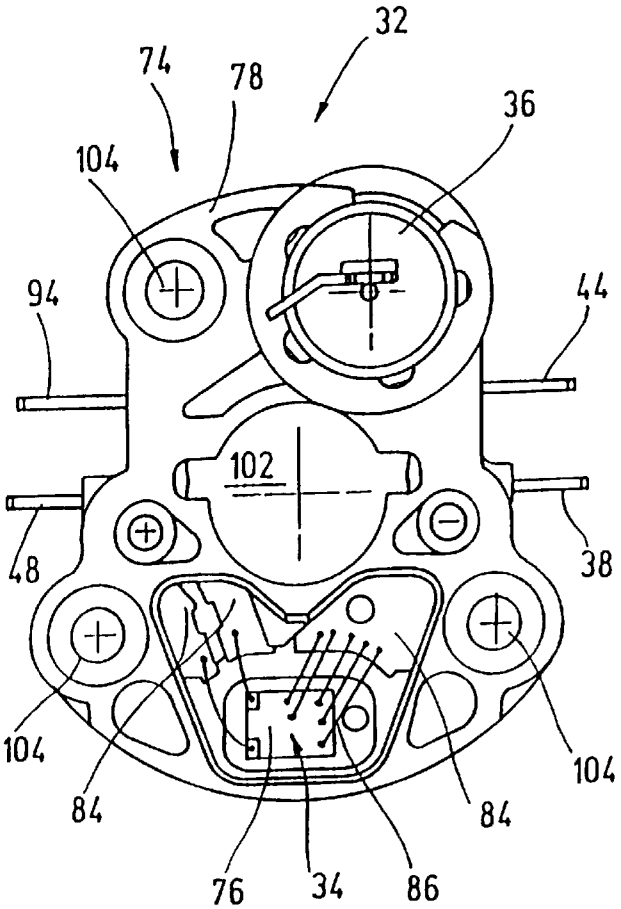
FIGS. 4 to 6 are different detailed views of the electronic relay from the starting device according to the invention.

It can be easily discerned from FIGS. 4 to 6 that the electronic relay 32 is embodied as a compact structural unit 74. The electronic relay 32 has the free-wheeling diode 36 and the power module 34, embodied as a chip 76. In this case the chip 76 supports the individual components of the power module 34, such as the switching means 56, the excess-voltage limitation, the temperature shut-off and the excess-current protection, for example, which are not shown here in detail. The power module 34 and the free-wheeling diode 36 are arranged in a housing 76, which is made of an insulating material. For example, the housing 78 can be a plastic extruded element. An installation space 80 for the free-wheeling diode 36 and an installation space 82 for the power module 34 have been formed inside the housing 78. A stamped grid 84, which forms the appropriate electrical strip conductors, is provided for making the electrical connections of the free-wheeling diode 36 and the power module 34. The stamped grid 84 is connected with the power module 34, in particular with the chip 76, by means of an appropriate number of bond wires 86. A collar 88 is formed on the stamped grid 84 for receiving the free-wheeling diode 36, into which the free-wheeling diode 36 is pressed with its base 90. To stabilize the stamped grid 84, it is interlockingly connected with corresponding insulating material areas 92 of the housing 78. The stamped grid 84 leads to the connecting terminals 38, 48, 44 and to the ground connection 94 (compare FIG. 1). The installation space 82 can be closed by means of a cap 96. The cap 96 can be releasably connected with the housing 78 by means of a snap-in connection 98. Because of the releasable connection of the cap 96 with the housing 78, the former can be removed, as represented in FIG. 5, so that the installation space 82 with the power module 34 becomes accessible. The chip 76 of the power module 34 is disposed via a base 100 on a cooling body 102, for example a copper block. The housing 78 has an approximately centrally arranged through-opening 102, through which the switch shaft 20 of the starter relay 14 can be guided. Because of the embodiment of the through-opening 102, the electronic relay 32 can be very advantageously integrated into the starter relay 14, wherein functional elements of the starter relay 14 can be disposed on both sides of the electronic relay. Furthermore, openings 104 embodied as bores are provided, through which the fastening screws for fastening the housing 78 can be guided.

A top view on a cover 106 of the starter relay 14 is represented in FIG. 7. The cover 106 has the main current contacts, here identified by 108 and 110, which can be connected with each other by means of the connecting bridge 22. The connecting terminals 38, 44, 48 and 94 are furthermore extended, so that contacting in accordance with the wiring represented in FIG. 1 can be performed. Therefore no additional connections to the outside need to be extended out of the starter relay 14.

Figure 8:
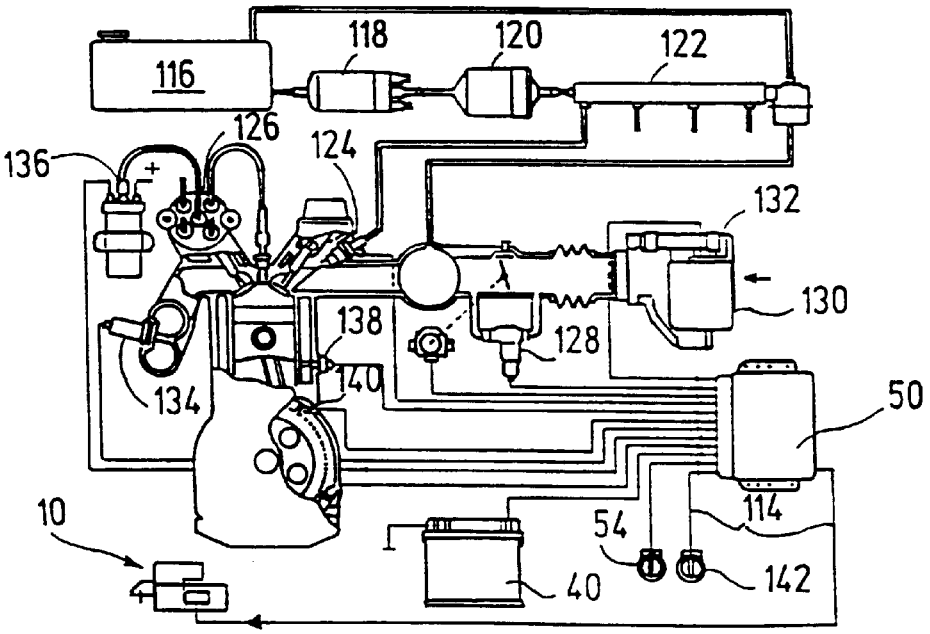
FIG. 8 is a schematic total view of an engine control of a motor vehicle.

A schematic total overview of the electronic control system of this motor vehicle is shown in FIG. 8. It becomes clear by means of the overview, that the engine control device 50 monitors or triggers a multitude of functional elements of the motor vehicle, wherein the detailed function and action of the engine control device 50 will not be addressed within the scope of the instant description. It is only intended to make clear by means of the overview, that by coupling the starter 10 with the engine control device 50 via the electronic relay 32 an integration of the starter 10 into the entire control management of the motor vehicle is possible in a simple manner. In this way it is possible to realize an actuation or a disengagement of the starter 10 as a function of further instantaneous conditions of other functional elements of the motor vehicle. A matched behavior becomes possible, wherein faulty functions can be prevented.

The individual elements of the system configuration will be briefly identified below, without providing a detailed explanation. The engine control device 50 receives information or issues appropriate control signals over the control lines 114 represented, for example to a fuel tank 116, an electric fuel pump 118, a fuel filter 120, a pressure regulator 122, injection valves 124, a high-tension distributor 126, an idle-rpm regulator 128, an air temperature sensor 130, a throttle flap switch 132, a Lambda probe 134, an ignition coil 136, an engine temperature sensor 138, an rpm pick-up 140, an airconditioning switch 142, the start ignition switch 54 as well as the starter 10. The voltage supply of the engine control device 50 is provided by means of the battery 40.

By integrating the starter 10 into the total system, the ability to trigger it becomes possible in a simple manner, wherein a trigger voltage, for example between 8 V and 24 V with a trigger current of less than 2 A for a battery voltage of 12 V or 24 V is possible. In this way an on the whole low-power triggering of the starter 10 is possible. By means of the electronic relay 32 it is possible to realize a number of other functions, besides the described function as an analog electronic low-energy interface between the starter 10 and the engine control device 50. In the process it is possible, among other things, to include the circuits of the temperature limitation, the excess-current limitation and the excess-voltage protection, which are integrated into the chip 76 of the power module 34, very advantageously into the triggering functions of the engine control device 50. In this way it is possible, for instance, to realize a start repeat function, wherein by means of a threshold temperature switch-off of the power transistor and its hysteresis a renewed starting attempt can be initiated after a lower threshold temperature has been reached. A further possibility of realizing the start repeat function consists in measuring the voltage at the connecting bridge 22 wherein, in case that there is no voltage after a defined, selectable period of time after initiation of the starting process, the starting process is interrupted and/or repeated after a further period of time.

Further than that, the switch-off of the starter 10 when a starter threshold temperature has been exceeded can be realized in that, for example, a single temperature sensor is associated with the starter, which for example, disposed near the carbon brushes of the starter motor 12, provides a signal which causes the switch-off of the electronic relay and thus the disconnection of the starter 10. It is furthermore possible to make an integral evaluation of the square of the motor current of the starter motor 12. This obtained value is proportional to a loss integral in the starter motor and therefore a measurement of the heating of the starter motor 12. When a defined selectable threshold value is exceeded, the starting process is broken off.

For preventing relay damage to the starter relay 14 by overheating, it is known to divide the winding into the pull-in winding 16 and the holding winding 18, which can have different wire cross sections. The great attractive force of the starter relay 14 at engagement is generated by the short-term parallel switching of both windings. The required reduced holding force during starting of the internal combustion engine, which is needed for a longer period of time than the attractive force, is generated by the holding winding 18 alone with a small current and small losses. Here, the electronic relay 32 offers the opportunity to realize both functions, i.e. the generation of the attractive force and the generation of the holding force, by means of one winding. This is achieved in that two different current strengths are made available by means of the electronic relay 32 by fixed clock conditions for engagement and holding of the starter relay 14. The reversing point can be determined, for example, by sensing the voltage applied to the connecting terminal 46. A manufacturing simplification and material savings are achieved by this for the starter relay 14.

Further than that, it is possible by means of the electronic relay to control the movement sequence of the armature of the starter relay 14 during engagement by means of clocked triggering or a current control, so that a dependable, low-wear and low-noise engagement becomes possible. This results, besides a noticeable increase in comfort, in an increase of the service life of the starter relay 14.

A further possibility lies in switching the winding of the starter relay 14 as a pre-resistor for the starter motor 12 by means of the electronic relay 32 in order to make possible the slow turning of the starter motor 12 at engagement. Since a relatively high relay current of approximately 200 A flows in connection with this, it is necessary to lay out the electronic relay 32 appropriately for these current strengths. This can be done, for example, by means of parallel switching of two power modules 34.

It is furthermore possible to realize a corresponding disengagement of the starter 10 after reaching starter idling rpm. In this way an effective protection of the starter 10 against too high rpm is achieved. Furthermore, an additional safety function for the free wheeling already achieved in a known manner is possible. Based on the double safety for the starter motor 12, a structural simplification in the field and armature areas of the starter motor 12 can take place. The rpm of the starter motor 12 can be determined, for example, by means of an rpm sensor or observation of the starter current. To this end it is possible to switch off the starter 10 at a time at which the starter current falls below a minimum value (idle current).

A further very advantageous possibility lies in realizing an electronic immobilizer for the motor vehicle by means of the electronic relay 32 in connection with the engine control device 32. The engine control device 50 can transmit a pulse sequence prior to each start procedure via the connecting terminal 48 to the electronic relay 32, which is compared with an internal pulse sequence by the electronic relay 32. The starting process is only initiated if the two pulse sequences match. If the pulse sequences do not match, the starting process is blocked by the electronic relay 32. To this end it is possible that each electronic relay 32 receives a fixed embedded code when it is produced which, for example, is coupled to the manufacturing date and can be changed monthly. The embedding of the code during the manufacturing process of the relay 32 can be realized, for example, via the high temperature logic provided in the chip 72, i.e. the excess-temperature protection circuit. It is furthermore possible to integrate a microprocessor or a programmable logic device into the electronic relay 32. Here the interrogation and response code can be freely programmed and fixed or changed in defined turns via the engine control device 50. When employing the electronic relay 32 as an electronic immobilizer, an appropriate mechanical safety or, by the selection of the installation location of the electronic relay 32, a manipulation for bridging it should be prevented. In the end it becomes possible by means of this to achieve the bridging of the electronic device only by destroying the starter 10, so that unauthorized moving of the motor vehicle is impossible.

The software of the engine control device 50 can also be employed very advantageously for controlling the starter 10 by means of the interface between the engine control device 50 and the electronic relay 32. For example, the automatic termination of the starting procedure when the internal combustion engine is running is possible, and the engagement of the starter 10 when the internal combustion engine is running can be prevented. As a whole, the starting process of a motor vehicle can be more dependably controlled and protected from erroneous operation to a large extent.

In accordance with exemplary embodiments, not represented, it is of course possible to trigger the electronic relay 32 by means of arbitrary other control devices, i.e. not by the engine control device 50. A direct actuation of the electronic relay 32 is possible, for example via the ignition lock 54, so that the functions integrated into the chip 76 of the power module 34 can be realized.

Different equipment variations of the electronic relay 32, in particular of the power module 34, are represented by means of FIGS. 9 to 15. In this case the concept is taken into account that the electronic relay 32 is designed to be redundant, i.e. logical links between circuit elements are provided for increasing the dependability of the initiation and the termination of the starting process, which prevent the function of the electronic relay 32 in case of the presence or absence of a defined piece of information. Elements which are the same as in the previous drawings figures have been provided with the same reference numerals in FIGS. 9 to 15, and they are not explained again. Only the particulars of the respective circuit variant will be addressed in detail.

Figure 9:
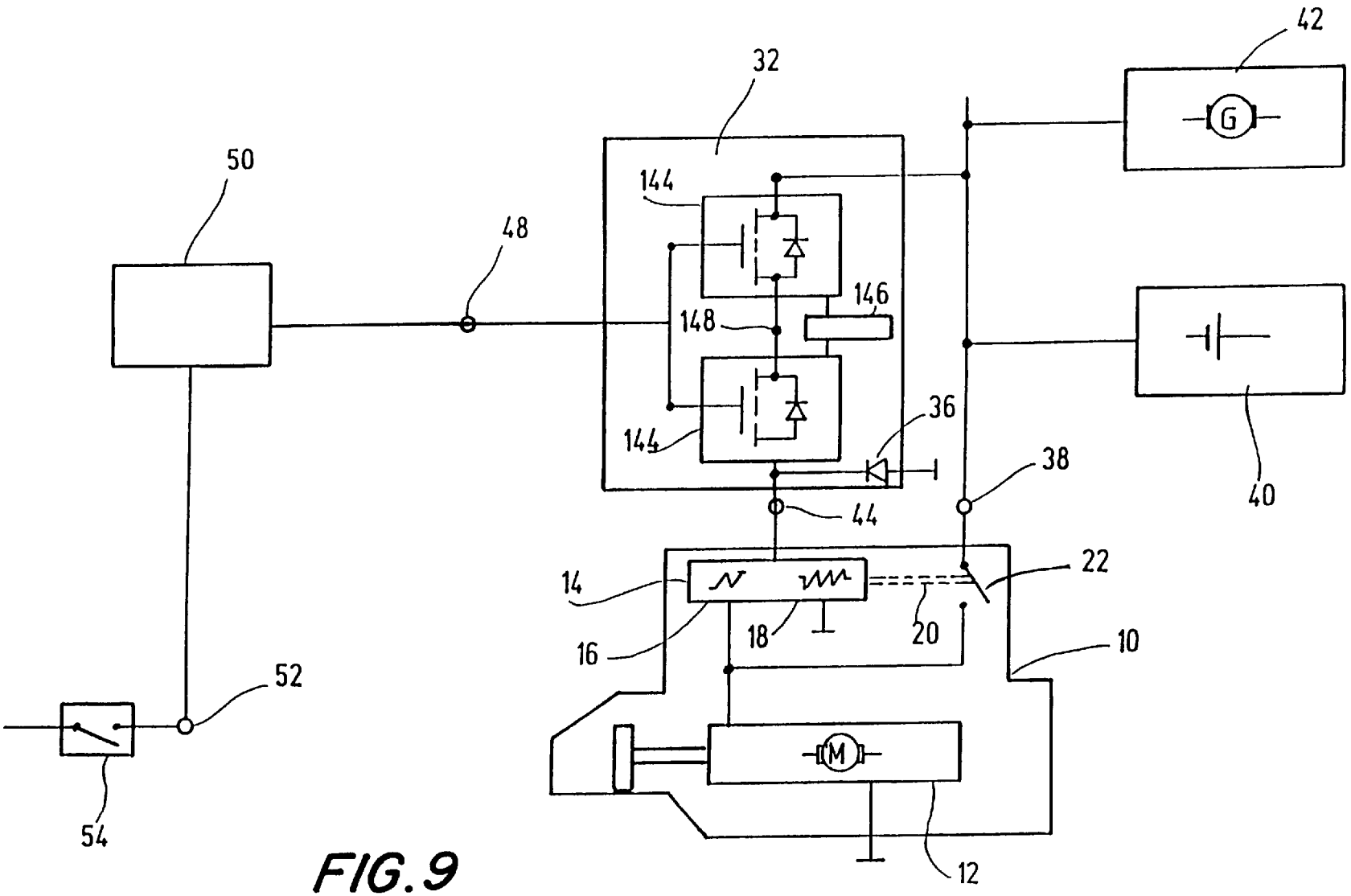
FIGS. 9 to 15 are circuit diagrams for different embodiments of the electronic relay for the starting device according to the invention.

In FIG. 9, the power module 34 consists of two serially connected power MOS chips 144. The PMOS transistors 144 are linked by means of a logic circuit 146. The logic circuit 146—which can possibly also be integrated into the PMOS chips 144—checks whether a voltage has been applied to a terminal 148 located between the transistors 144 in the switched-off state, i.e. no signal is applied to the connecting terminal 48. In case a voltage is applied to the terminal 148, an error is sensed and the transistors 144 are blocked via the logic circuit 146, so that the initiation or a renewed initiation of a starting process is prevented. Besides the blockage of the electronic relay 32, this error report can also be supplied to an evaluation unit, not represented, for further processing.

Figure 10:
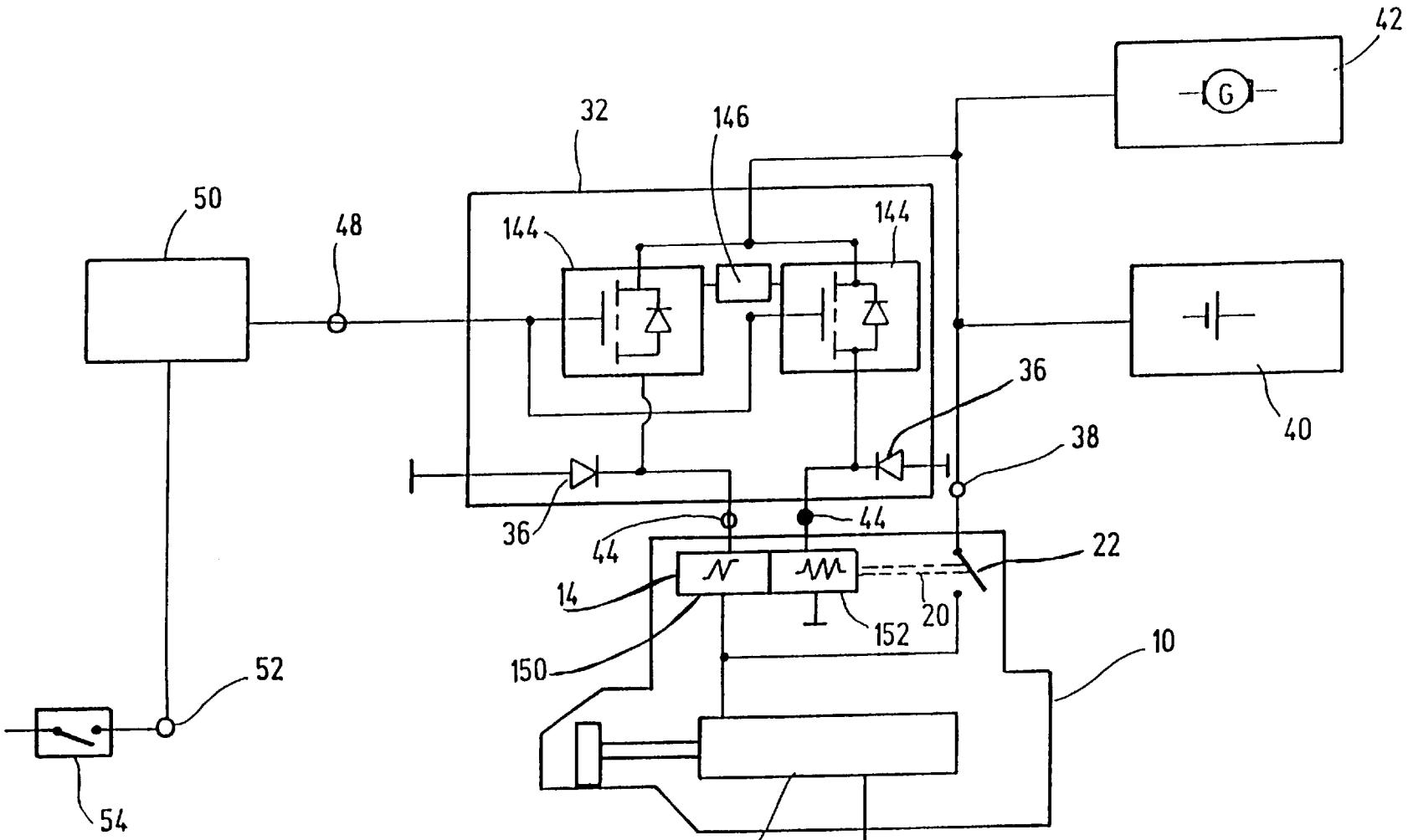

In the circuit variant shown in FIG. 10, the electronic relay 32 has two PMOS transistors 144 switched parallel with each other. These are again linked to each other via the logic circuit 146. A first transistor 144—represented on the left here—triggers a first winding 150, and a second transistor 144 a second winding 152 of the starter relay 14. The windings 150 and 152 have been laid out in such a way that the attraction of the starter relay 14 is only possible if both windings are provided with current. However, when producing the holding force, providing the winding 152 with current is sufficient. The logic circuit 146 monitors the transistors 144 to determine whether switching takes place without the application of a control signal at the connecting terminal 48. In case one of the relays 144 is switched through, an error is detected and the electronic relay 32 is blocked, so that further starting attempts can be prevented.

Figure 11:
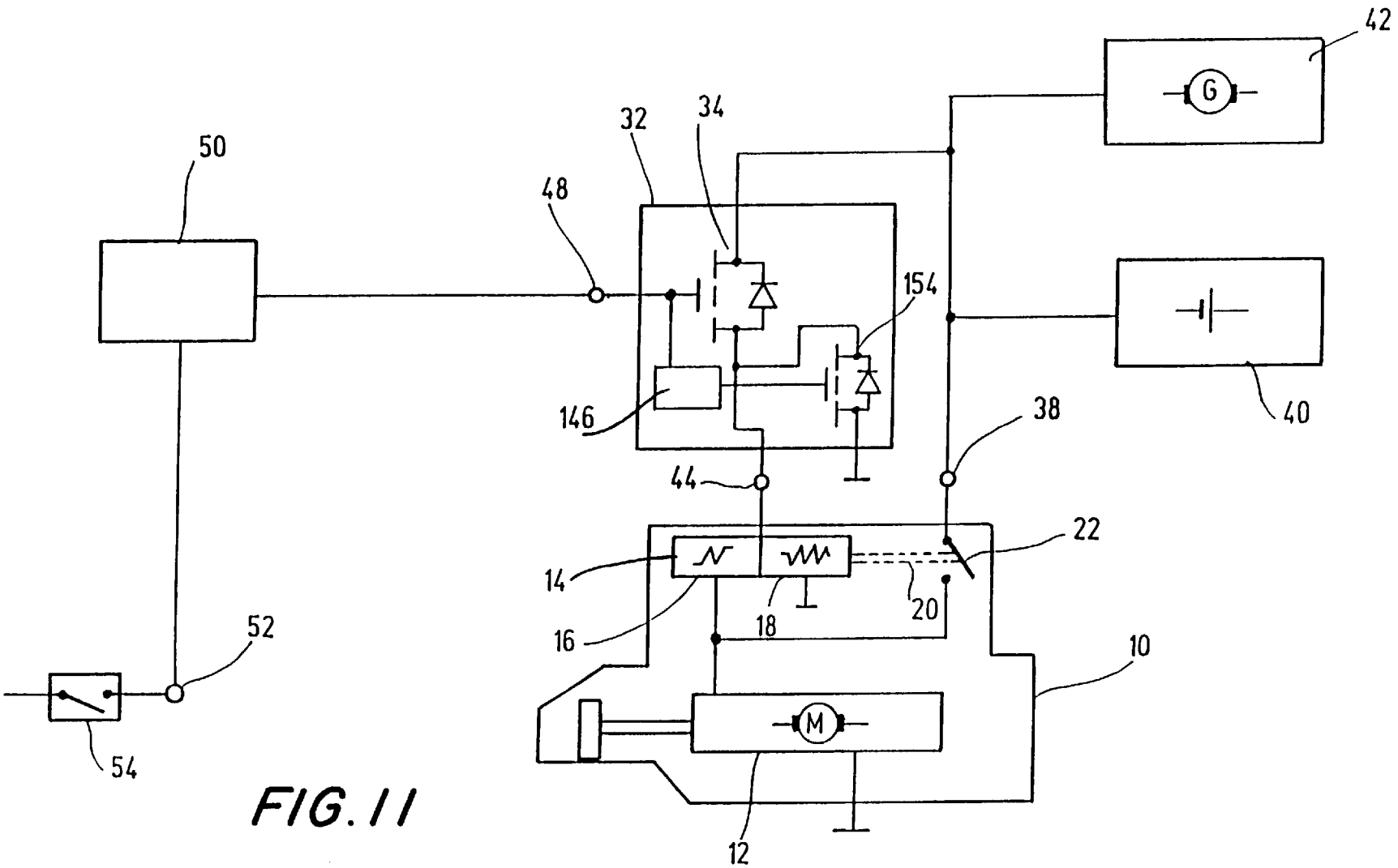

In connection with the variant represented in FIG. 11, the free-wheeling diode 36 in FIG. 1 is replaced by a transistor 154, which is linked via the logic circuit 146 with the power module 34. In this case the logic circuit 146 monitors whether the power module 34 has been erroneously switched through. If this is the case, the transistor 154 is triggered, so that the windings 16 and 18 of the control relay 14 are short-circuited via the connecting terminal 44. The initiation of a starting process is dependably prevented by this. Furthermore, the transistor 154 is laid out for higher current strengths than the transistor of the power module 34. By means of this it is assured that in case of an error the bond connections 86 (FIG. 5) melt and in this way act as a fuse.

Figure 12:
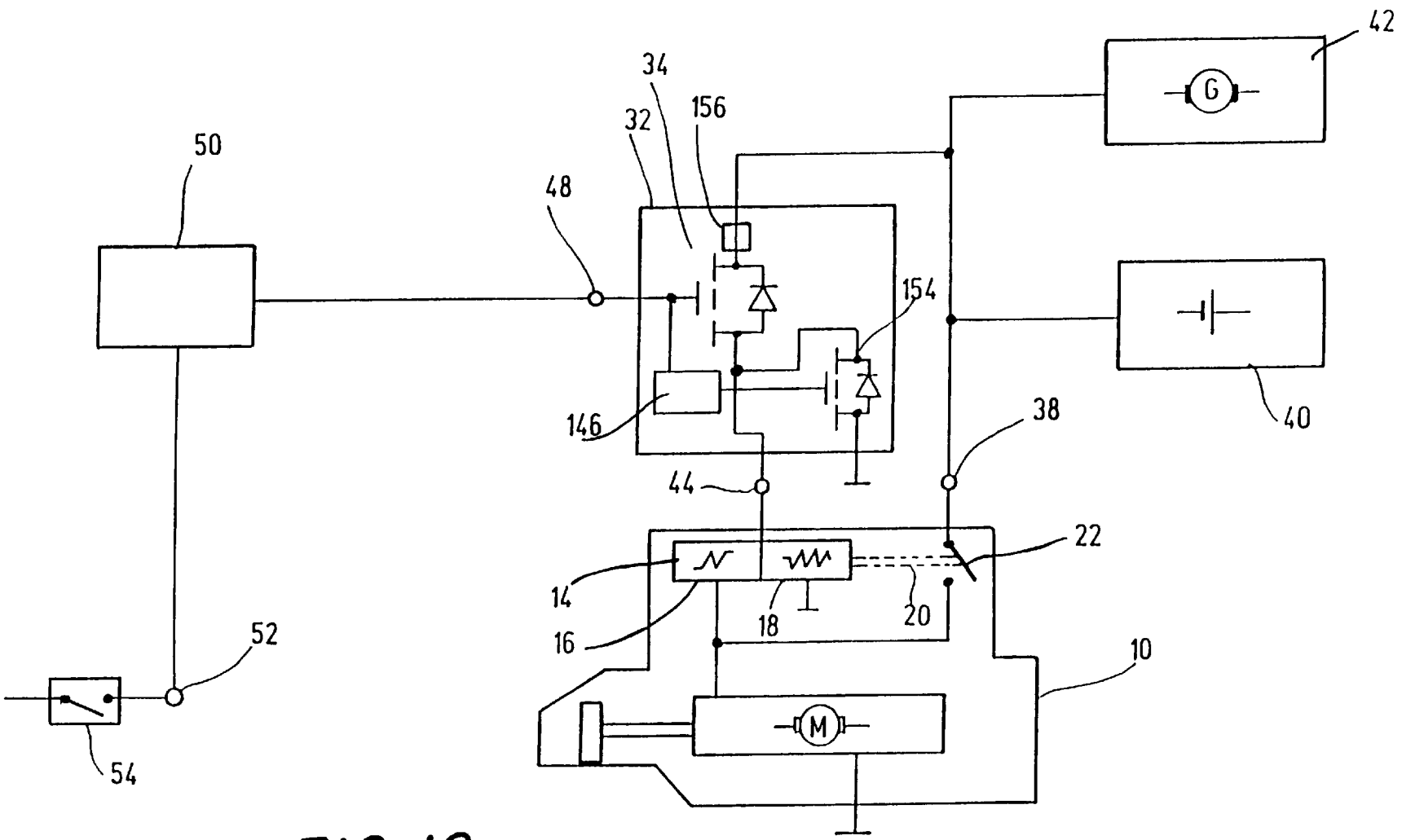

In the circuit variant represented in FIG. 12, a safety element 156 is associated with the power module 34 in addition to the exemplary embodiment in accordance with FIG. 11. The safety element 156, which can be embodied as a separate component or can be integrated into a connecting line between the individual components, here takes over the switch-off of the electronic relay when high currents appear in case of an error.

Figure 13:
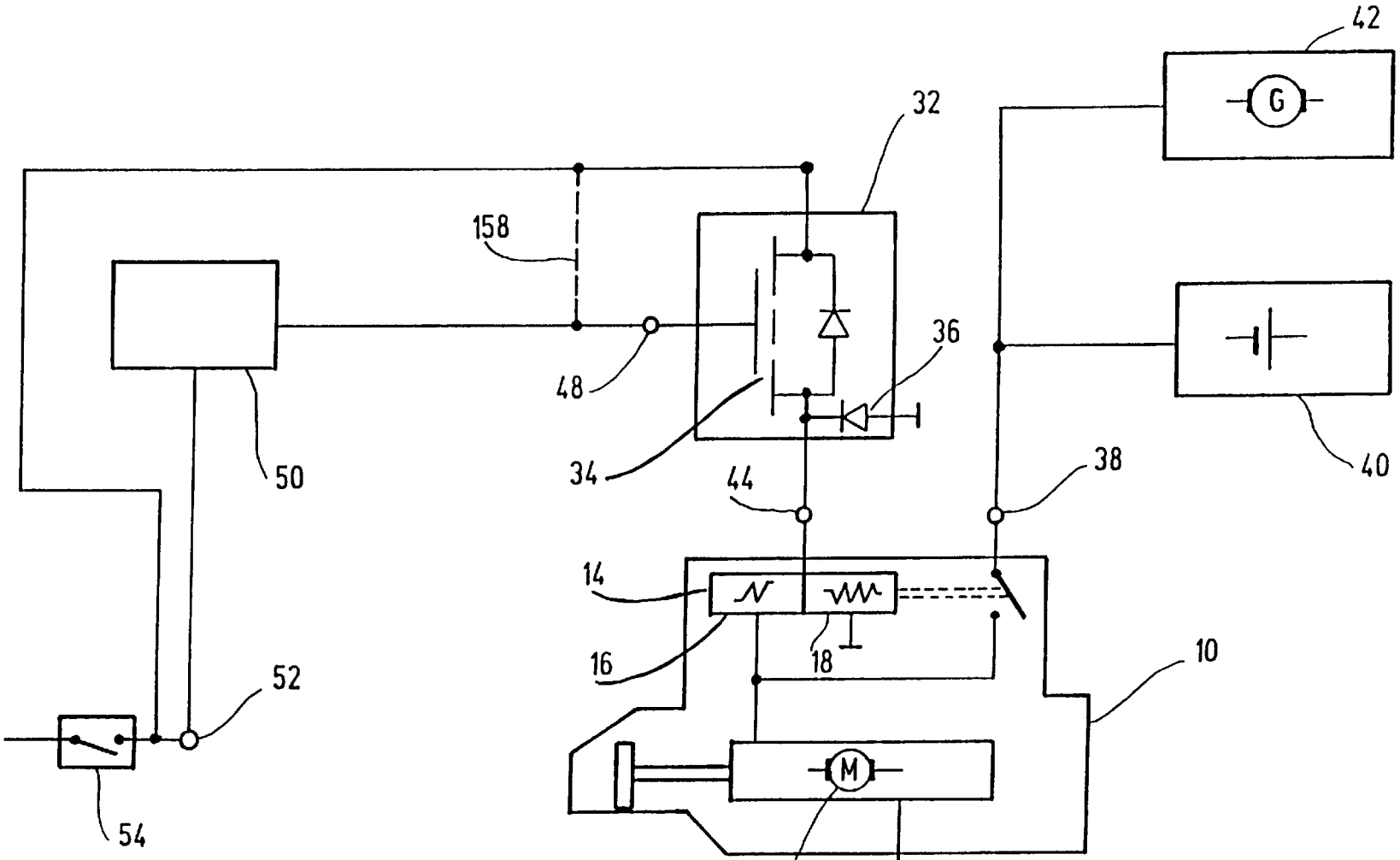

FIG. 13 represents an embodiment variant in which the electronic relay 32 is connected with the connecting terminal 52 instead of with the connecting terminal 38, so that the electronic relay 32 can be switched on or off via the ignition lock 54. By means of this a manual intervention into the sequence of the starting process of the starter 10 becomes possible. In accordance with a further embodiment variant the connection 158, shown in dashed lines in FIG. 13, can be provided, which bridges the engine control device 50. In this case the connection between the engine control device 50 and the connecting terminal 48 can be omitted, so that triggering of the electronic relay 32 is possible independently of the engine control device 50. In this case the electronic relay 32 is exclusively triggered via the ignition lock 54 and connected with the voltage source. Redundancy is achieved in this case by the series connection of the ignition lock 54 and the electronic relay 32.

The mode of functioning of the logical circuit 146 in accordance with the embodiment variant represented in FIG. 9, wherein the electronic relay 32 has two series-connected transistors 144, will be explained in more detail by means of FIGS. 14 and 15. The transistors 144 have been identified here as transistors 144' and transistor 144" for better differentiation. Here, the logic circuit 146 of FIG. 9 consists of two logic modules 158 and 160, wherein the logic module 158 is integrated into the chip of the PMOS transistor 144', and the logic module 160 into the chip of the PMOS transistor 144". It is made clear by FIG. 14 that one side of the logic modules 158 and 160 is respectively connected with the connecting terminal 48 and with the ground, and the other side with the gate, source or drain of the transistors 144. There is furthermore a coupling of the logic modules 158 and 160 by means of a transverse connection 162.

Figure 15:
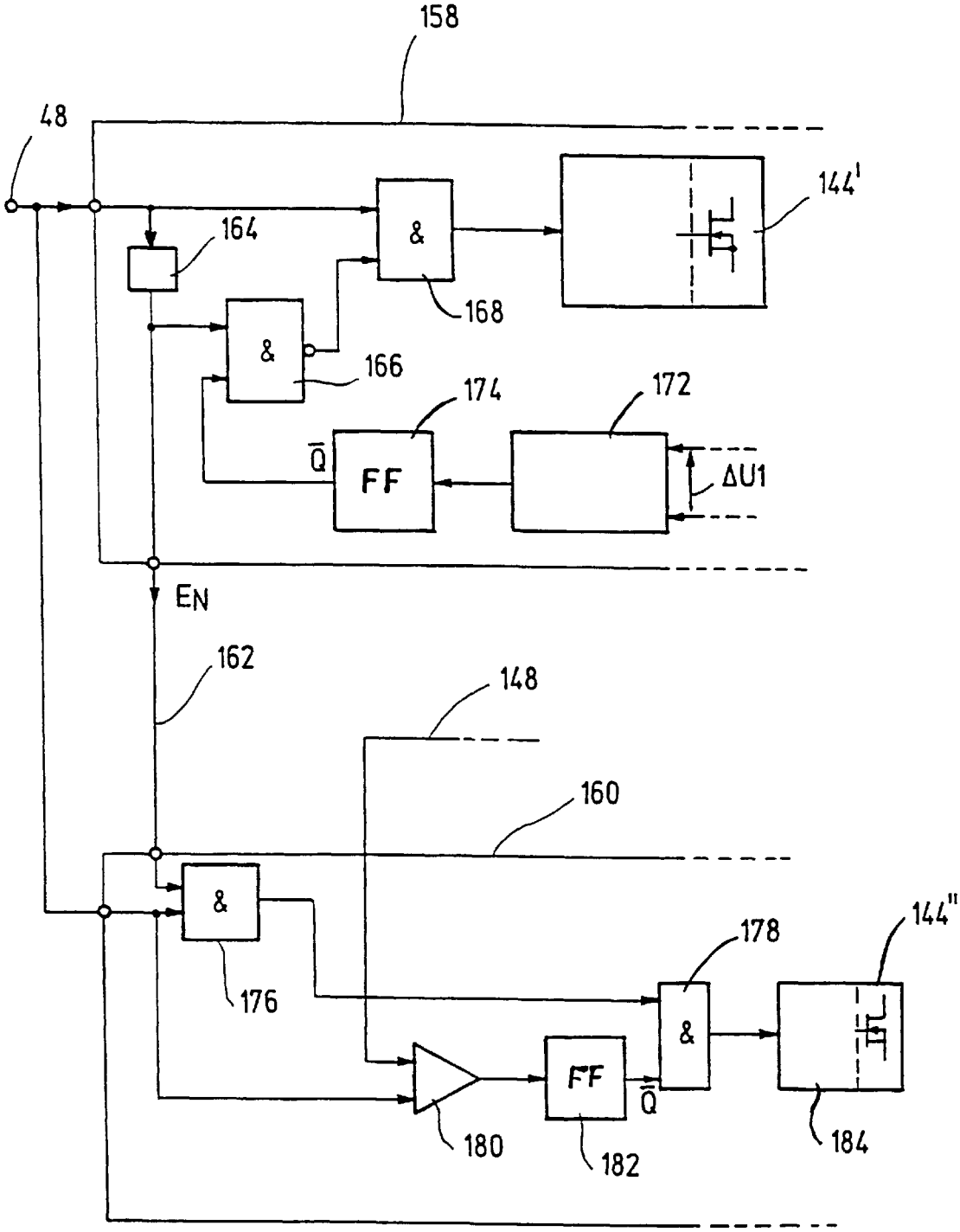

In accordance with FIG. 15, the logic module 158 has a time delay member 164, one end of which is connected with the connecting terminal 48 and the other end with a first input of a NAND member 166. The output of the NAND member 166 is connected with a first input of an AND member 168. The second input of the AND member 168 is connected with the connecting terminal 48. One output of the AND member 168 is connected with a logical control 170 of the transistor 144'. A monitoring member 172 is furthermore provided, whose output is connected with a flip-flop 174. The Q output of the flip-flop 174 is connected with the second input of the NAND member 166.

The second logic module 160 has a second AND member 176, whose first input is connected via the transverse connection 162 with the output of the time delay member 164 of the logic module 158. The second input of the AND member 176 is connected with the connecting terminal 48. An output of the AND member 176 is connected with a first input of a third AND member 178. The connecting terminal 48 is furthermore connected with a first input of a comparator 180, whose second input is connected with the terminal 148. One output of the comparator 180 is connected with a flip-flop 182, whose Q output is connected with the second input of the AND member 178. The output of the AND member 176 is connected with a logic control 184 of the transistor 144".

Figure 14:
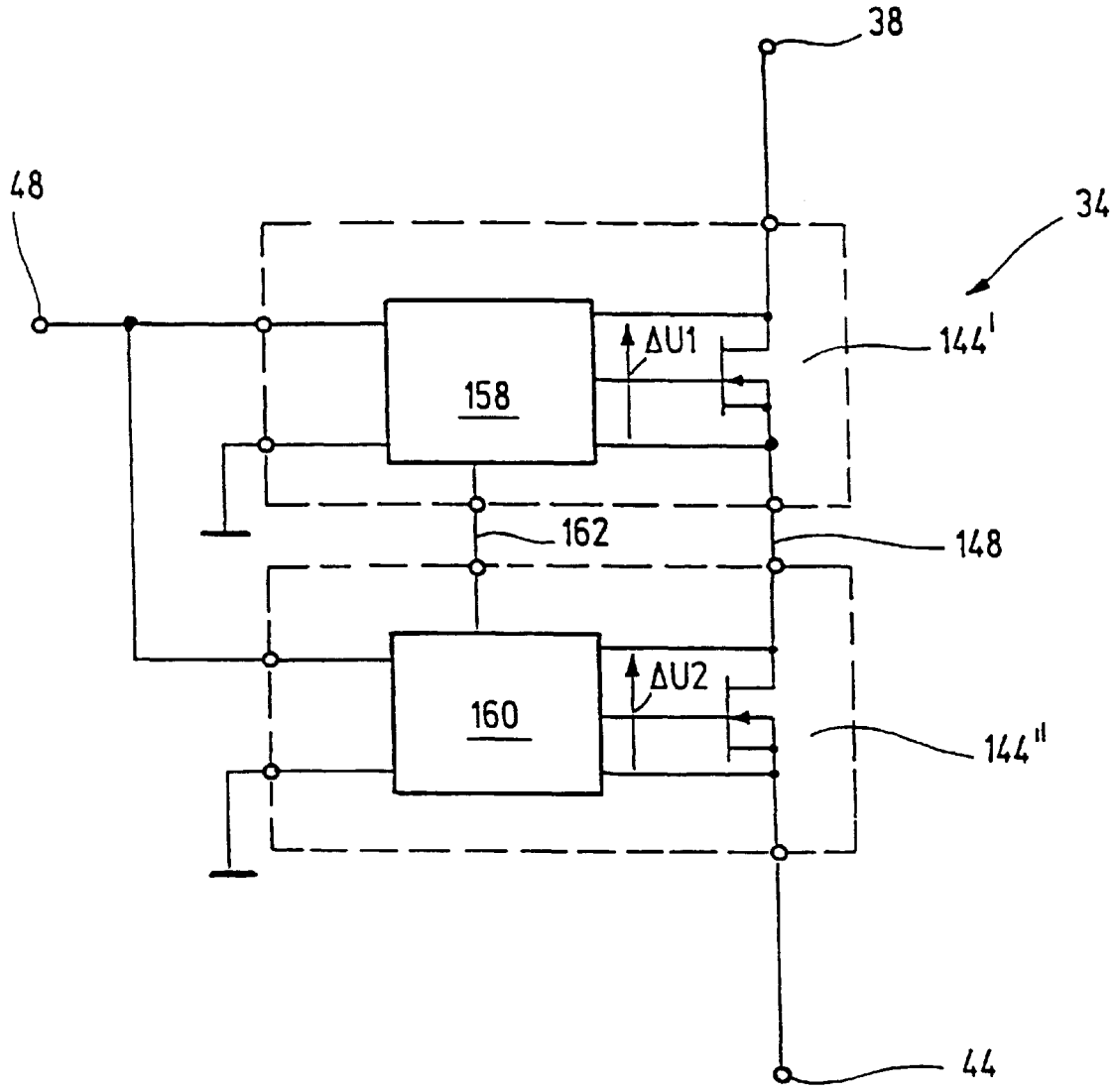

The circuit arrangement represented in FIGS. 14 and 15 performs the following function:

If a control signal, i.e. a high signal, is applied to the connecting terminal 48 via the engine control device 50, the transistor 144' is switched on. Initially the transistor 144" is not switched on, since the input AND member 176 of the power module 160 is connected with the time delay member 164, and a switch-through only takes place when a signal in the high state is applied to the connecting terminal 48 as well as the transverse connection 162. By means of the monitoring member 172 it is detected whether a current flows through the transistor 144'. In case no current flows, a difference voltage DeltaU between the source and the drain of the transistor 144' equals zero. Since the transistor 144" is still blocked, this means that there is no error if no current flows through the transistor 144'. The flip-flop 174 is set by this (Q=low), so that via the linkage of the AND members 166 and 168 in connection with the time delay member 164 the transistor 144' remains switched on even when the delay time of the time delay member 164 has run out.

In case the transistor 144" is short-circuited in case of an error, the monitoring member 172 detects a current flow through the transistor 144', because DeltaU is greater than 0. A signal for the flip-flop 174 is provided by this, so that it is not set (Q=high). Since now a high signal is applied at the second input of the NAND member 166, the transistor 144' is switched off at the end of the delay time of the time delay member 164. In this way monitoring of the transistor 144" can be performed via the power module 158.

In the OFF state, i.e. no signal is present at the connecting terminal 48, so that the low state results, the transistor 144' is not switched through, so that the transistor 144" which is switched in series with it is not supplied with a supply voltage. However, if the transistor 144' is defective, i.e. shorted, a supply voltage is applied to the connecting terminal 148, although no control signal is provided via the connecting terminal 148. Thereupon the flip-flop 182 is set (Q=low) via the comparator 180, so that the transistor 144" cannot be switched through via the linkage with the AND member 178, even if a control signal is now applied to the connecting terminal 48. In this way monitoring of the transistor 144' is performed quasi by means of the logic module 160.

What is claimed is:

1. A starting device for starting an internal combustion engine, said starting device comprising a starter motor (12) with means for engaging the internal combustion engine to turn over the internal combustion engine;

a voltage source (40) of electrical power for the starter motor;

a starter relay (14) for connecting the voltage source with the starter motor to activate the starter motor; and an electronic device for triggering the starter relay;

wherein the electronic device (30) is formed by an electronic relay (32), the electronic relay (32) is arranged on the starter motor (12) or in the starter relay (14) and the electronic relay (32) has a logic signal input (47,48) for control signals from a motor controller (50) of the internal combustion engine; and wherein said electronic relay (32) comprises a power module (34) and a redundancy circuit and wherein the power module (34) has a logic circuit (146) and two transistors (144', 144") redundantly coupled with each other by means of the logic circuit (146), whereby operation of the starting device is prevented when one of the two transistors is defective.

2. The starting device as defined in claim 1, wherein the transistors (144',144") are connected in series.

3. The starting device as defined in claim 1, wherein the transistors (144',144") are connected in parallel.

4. The staring device as defined in claim 1, wherein the electronic relay (32) includes a protective diode (36) connected in parallel with the power module (34).

5. The starting device as defined in claim 1, further comprising a relay module (66) containing the electronic relay (32).

6. The starting device as defined in claim 5, wherein said relay module (66) is attached to a pole housing (68) of the starter motor (12).

7. The starting device as defined in claim 5, wherein said relay module (66) is attached under a commutator bearing cap (70) of the starter motor (12).

8. The starting device as defined in claim 5, wherein the relay module (66) is arranged between engagement and holding windings (16,18) and a connecting bridge (22) of the starter relay (14) and has a through-opening (102), through which a switch shaft (20) of the starter relay (14) extends.

9. The starting device as defined in claim 1, wherein said internal combustion engine is installed in a motor vehicle and the motor controller (50) and said starter motor (12) are formed for starting and control of said internal combustion engine in said motor vehicle.

* * * * *